US006678483B2

(12) United States Patent
Brown et al.

(10) Patent No.: US 6,678,483 B2
(45) Date of Patent: Jan. 13, 2004

(54) SERIAL DRIVE SENSING FAULT CLEANING DEVICE DETECTOR

(75) Inventors: Kenneth J. Brown, Penfield, NY (US); George D. Gross, Rochester, NY (US); Charles D. Odum, Rochester, NY (US)

(73) Assignee: Nexpress Solutions LLC, Rochester, NY (US)

( * ) Notice: Subject to any disclaimer, the term of this patent is extended or adjusted under 35 U.S.C. 154(b) by 0 days.

(21) Appl. No.: 10/163,109

(22) Filed: Jun. 5, 2002

(65) Prior Publication Data

US 2003/0044192 A1 Mar. 6, 2003

Related U.S. Application Data

(60) Provisional application No. 60/317,398, filed on Sep. 5, 2001.

(51) Int. Cl.[7] ..... G03G 21/00

(52) U.S. Cl. ..... 399/34; 399/71; 399/353

(58) Field of Search ..... 399/71, 9, 343, 399/349, 353, 356, 358, 27, 360, 34; 430/125; 15/256.5, 256.51, 256.52

(56) References Cited

U.S. PATENT DOCUMENTS

| | | | | | |
|---|---|---|---|---|---|
| 5,600,405 | A | * | 2/1997 | Umeda et al. | 399/71 |
| 5,617,195 | A | * | 4/1997 | Torimaru et al. | 399/27 |
| 5,850,588 | A | * | 12/1998 | Yoshikawa | 399/71 |
| 5,905,932 | A | | 5/1999 | Morse et al. | 399/353 |
| 6,009,301 | A | * | 12/1999 | Maher et al. | 15/256.5 |
| 6,154,619 | A | * | 11/2000 | Boockholdt et al. | 399/24 X |

* cited by examiner

*Primary Examiner*—William J. Royer

(57) ABSTRACT

A method and structure for a detone cleaner assembly for an image processing apparatus includes a drive motor, a plurality of rotating components, and a current sensor for sensing a current being drawn by the drive motor. The rotating components form a serial connection to distribute a rotational force produced by the drive motor.

8 Claims, 4 Drawing Sheets

SERIAL DRIVE SENSING FAULT CLEANING DEVICE DETECTOR

CROSS REFERENCE TO RELATED APPLICATION

Reference is made to and priority claimed from U.S. Provisional Application Ser. No. 60/317,398 filed Sep. 5, 2001, entitled SERIAL DRIVE SENSING FAULT CLEANING DEVICE DETECTOR

BACKGROUND OF THE INVENTION

1. Field of the Invention

The present invention relates in general to a fault sensor in a cleaning assembly for a detone roller, and more particularly to a cleaning assembly which has all moving elements connected serially, such that fault can be detected by observing the current of the driving motor or the movement of the last element in the serial chain.

2. Description of the Related Art

In a typical commercial reproduction apparatus (electrostatographic copier/duplicators, printers, or the like), a latent image charge pattern is formed on a uniformly charged dielectric member. Pigmented marking particles are attracted to the latent image charge pattern to develop such images on the dielectric member. A receiver member is then brought into contact with the dielectric member. An electric field, such as provided by a corona charger or an electrically biased roller, is applied to transfer the marking particle developed image to the receiver member from the dielectric member. After transfer, the receiver member bearing the transferred image is separated from the dielectric member and transported away from the dielectric member to a fuser apparatus at a downstream location. There the image is fixed to the receiver member by heat and/or pressure from the fuser apparatus to form a permanent reproduction thereon.

However, not all of the marking particles are transferred to the printing material and some remain upon the belts or drum. Therefore, a cleaning assembly is commonly used to remove the excess marketing particles. The cleaning assembly usually includes an electrostatic cleaning brush (detone roller), a skive, and a receptacle to hold the excess marking particles (waste toner material). The devices within the cleaner assembly generally rotates to remove waste particles. To make the various devices rotate, one or more electric motors are connected to the devices through a system of gears and axles. In order to increase reliability, it is desirable to have each of the rotating devices connected directly (or as near as possible to being directly connected) to an electric motor. Therefore, if one motor drives multiple rotating devices, it is conventionally desirable to have the rotating devices each directly connected to the main drive gear of the driving motor. In this manner, the rotating devices are said to be connected to the single drive motor "in parallel" because each rotating device is connected to the same source (e.g., the main drive wheel of the driving motor). Obviously, because of space requirements, the different rotating devices will be connected to different points of the main drive gear of the driving motor.

It is difficult in the conventional structures to determine when a gear or axle of a rotating device has become broken or worn to the point where it fails to properly turn. Therefore, the image processing device may continue to operate with a defective cleaner assembly before the defect within the cleaner assembly can be identified. This causes the entire image processing apparatus to become contaminated, which requires extensive servicing of the entire apparatus. Therefore, there is a need to provide a structure which allows a malfunction within the cleaner assembly to be immediately identified so as to allow the entire image processing apparatus to be shut down before contamination occurs. The invention described below provides such a structure and avoids having to clean the entire image processing apparatus when a malfunction occurs within a cleaner assembly.

SUMMARY OF THE INVENTION

In view of the foregoing and other problems, disadvantages, and drawbacks of the conventional cleaner assembly the present invention has been devised, and it is an object of the present invention to provide a structure and method for an improved cleaner assembly.

In order to attain the object(s) suggested above, there is provided, according to one aspect of the invention, a method and structure for a detone cleaner assembly for an image processing apparatus. The cleaner assembly includes a drive motor, a plurality of rotating components, such that the rotating components form a serial connection to distribute a rotational force produced by the drive motor, and a current sensor for sensing a current being drawn by the drive motor.

BRIEF DESCRIPTION OF THE DRAWINGS

The foregoing and other objects, aspects and advantages will be better understood from the following detailed description of a preferred embodiment(s) of the invention with reference to the drawings, in which.

DETAILED DESCRIPTION OF PREFERRED EMBODIMENTS OF THE INVENTION

Figure 1A:
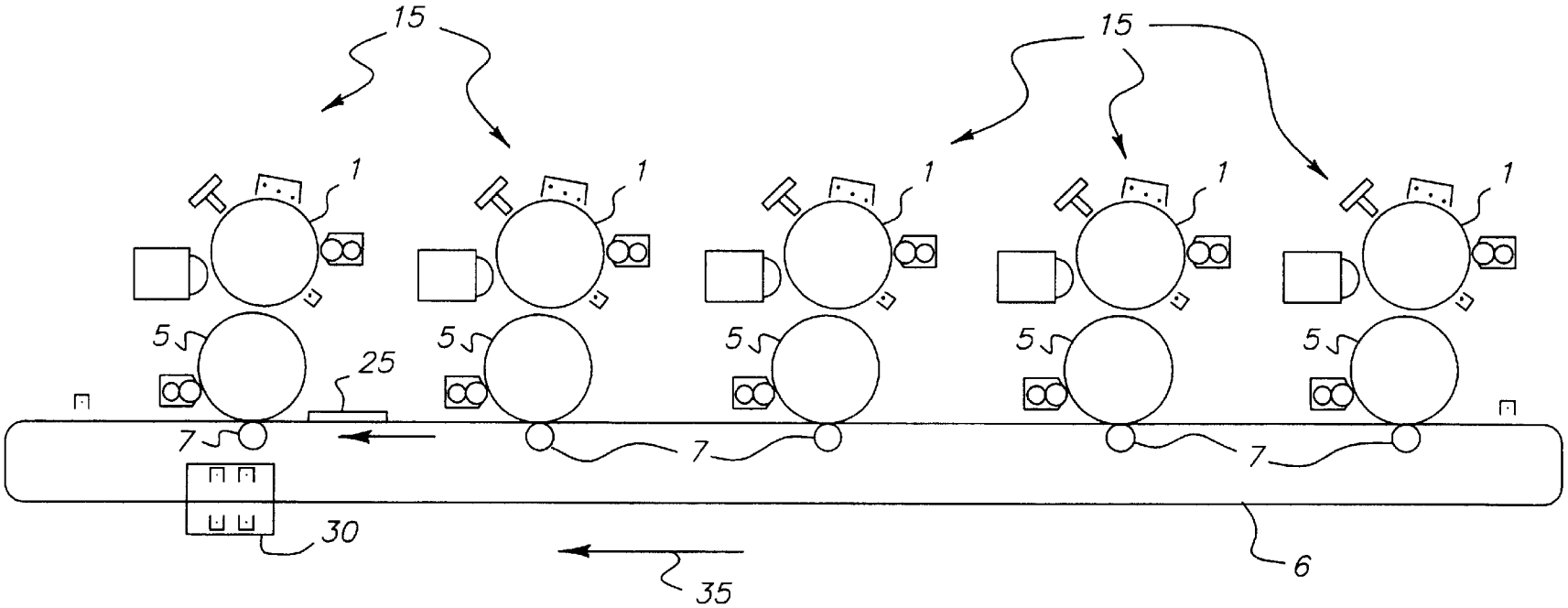
FIGS. 1A and 1B are side elevation schematic views of a color printer apparatus utilizing a cleaning apparatus of the invention.

FIG. 1A illustrates an apparatus in which the invention may be used. A dielectric conveyer 6 is drivable to move a receiving sheet 25 (e.g., paper, plastic, etc.) past a series of imaging stations 15. One of the imaging stations 15 is shown in greater detail in FIG. 1B.

With the invention, a primary image member (for example a photoconductive drum) 1 within each imaging station 15 is initially charged by a primary charging station 2. This charge is then modified by print head 3 (e.g., LED printhead) to create an electrostatic image on the primary image member 1. A development station 4 deposits toner on the primary image member 1, to form a toner image corresponding to the color of toner in each individual imaging station 15. The toner image is electrostatically transferred from the primary image member 1 to an intermediate transfer member 5. The intermediate transfer member 5 is preferably a roller or a drum. While both the primary image and intermediate transfer members 1, 5 are shown as drums, as would be known by one ordinarily skilled in the art, these could also comprises belts or similar surfaces. The primary image and intermediate transfer members 1, 5 are used in these examples to simplify the explanation of the invention; however, the invention is not limited to drums, but instead is applicable to all similar structures/surfaces.

Figure 2:
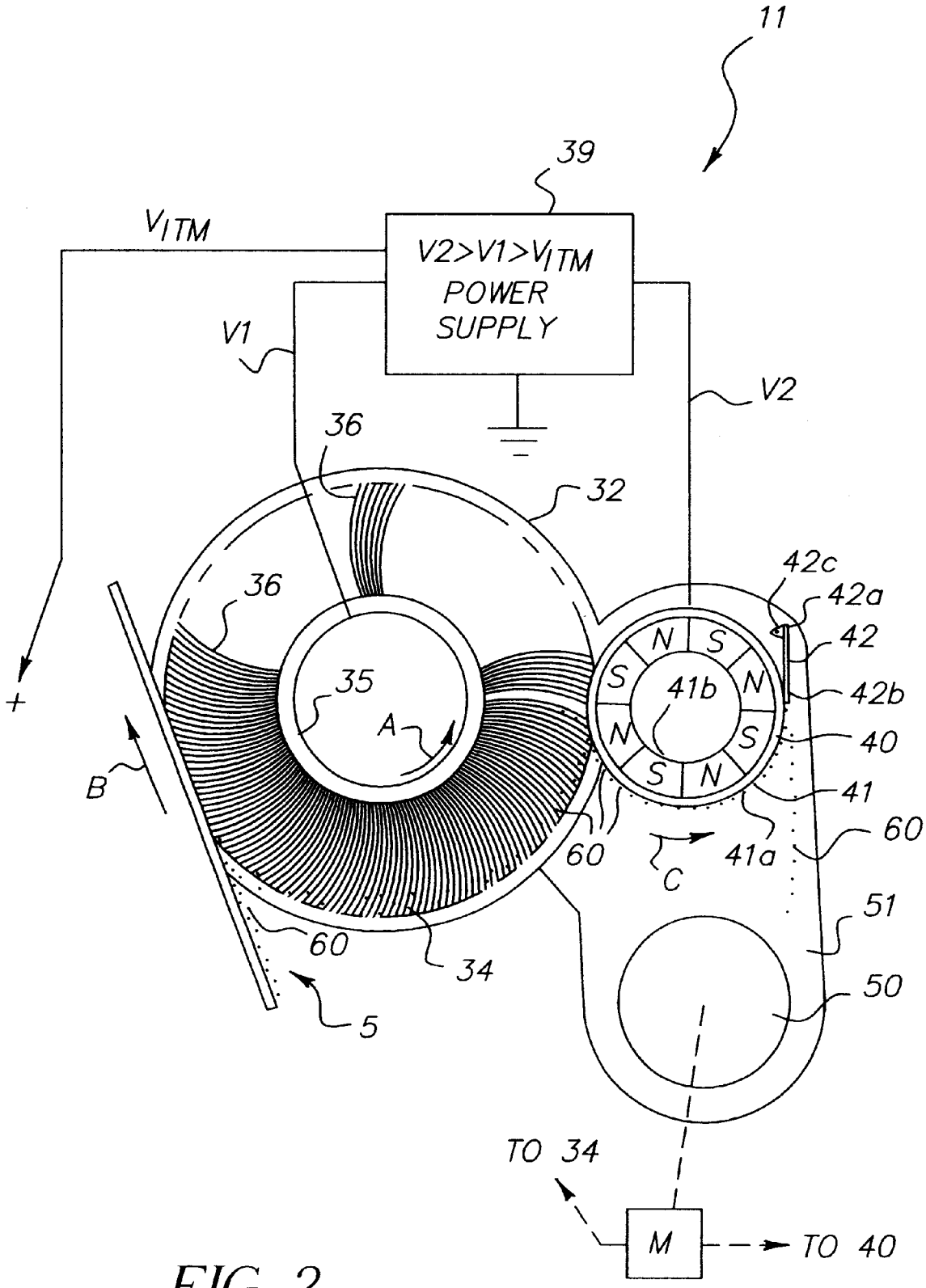
FIG. 2 is a side elevation schematic showing in greater detail the cleaning apparatus forming a part of the apparatus of FIG. 1B.

After the charged toner is transferred to the intermediate transfer member 5, there still remains some waste toner particles that need to be removed from the primary image member 1. The invention uses a pre-cleaning erase light emitting diode (LED) lamp 9 in combination with pre-cleaning charging station 10 in order to electrostatically modify the surface potential of the non-image areas of the primary image member 1 and the charge on the waste toner remaining on the primary image member 1, respectively. In addition, a cleaning station 8 is included to physically remove any remaining waste toner particles. The cleaning station 8 is illustrated in FIG. 2 and discussed in greater detail below.

A transfer nip is used between a transfer backer roller 7 and the intermediate transfer member 5 to transfer the toner image to the receiving sheet 25. In a similar manner to that discussed above, the remaining waste toner particles that remain on the intermediate transferred member 5 after the toner has been transferred to the sheet 25, are removed using a pre-cleaning charging station 12 and a cleaning station 11. Once again, the details of the cleaning station 11 are shown in FIG. 2 and are discussed below in detail. The receiving sheet 25 is transported by a dielectric conveyor 6 to a fuser 30 where the toner image is fixed by conventional means. The receiving sheet is then conveyed from the fuser 30 to an output tray 35.

The toner image is transferred from he primary image member 1 to the intermediate transfer member 5 in response to an electric field applied between the core of intermediate transfer member 5 and a conductive electrode forming a part of primary image member 1. The toner image is transferred to the receiving sheet 25 at the nip in response to an electric field created between he backing roller 7 and the intermediate transfer member 5. Thus, intermediate transfer member 5 helps establish both electric fields. As is known in the art, a polyurethane roller containing an appropriate amount of anti-static material to make it of at least intermediate electrical conductivity can be used for establishing both field. Typically, the polyurethane or other elastomer is a relatively thick layer; e.g. one- quarter inch thick, which has been formed on an aluminum base.

Preferably, the electrode buried in the primary image member 1 is grounded for convenience in cooperating with the other stations in forming the electrostatic and toner images. If the toner is a positively-charged toner, an electrical bias $V_{ITM}$ applied to intermediate transfer member 5 of typically −300 to −1,500 volts will effect substantial transfer of toner images to intermediate transfer member 5. Then, in order to transfer the toner image onto a receiving sheet 25, a bias, e.g., of −2,000 volts or greater negative voltages is applied to backing roller 7 to again urge the positively charged toner to transfer to the receiving sheet. Schemes are also known in the art for changing the bias on intermediate transfer member 5 between the two transfer locations so that transfer backing roller 7 need not be at such a high potential.

The intermediate transfer member 5 has a polyurethane base layer upon which a thin skin is coated or otherwise formed having the desired release characteristics. The polyurethane base layer preferably is supported upon an aluminum core. The thin skin may be a thermoplastic and should be relatively hard, preferably having a Young's modulus in excess of $5*10^7$ Newtons per square meter to facilitate release of the toner to ordinary paper or another type of receiving sheet. The base layer is preferably compliant and has a Young's modulus of $10^7$ Newtons per square meter or less to assure good compliance for each transfer.

Figure 1B:
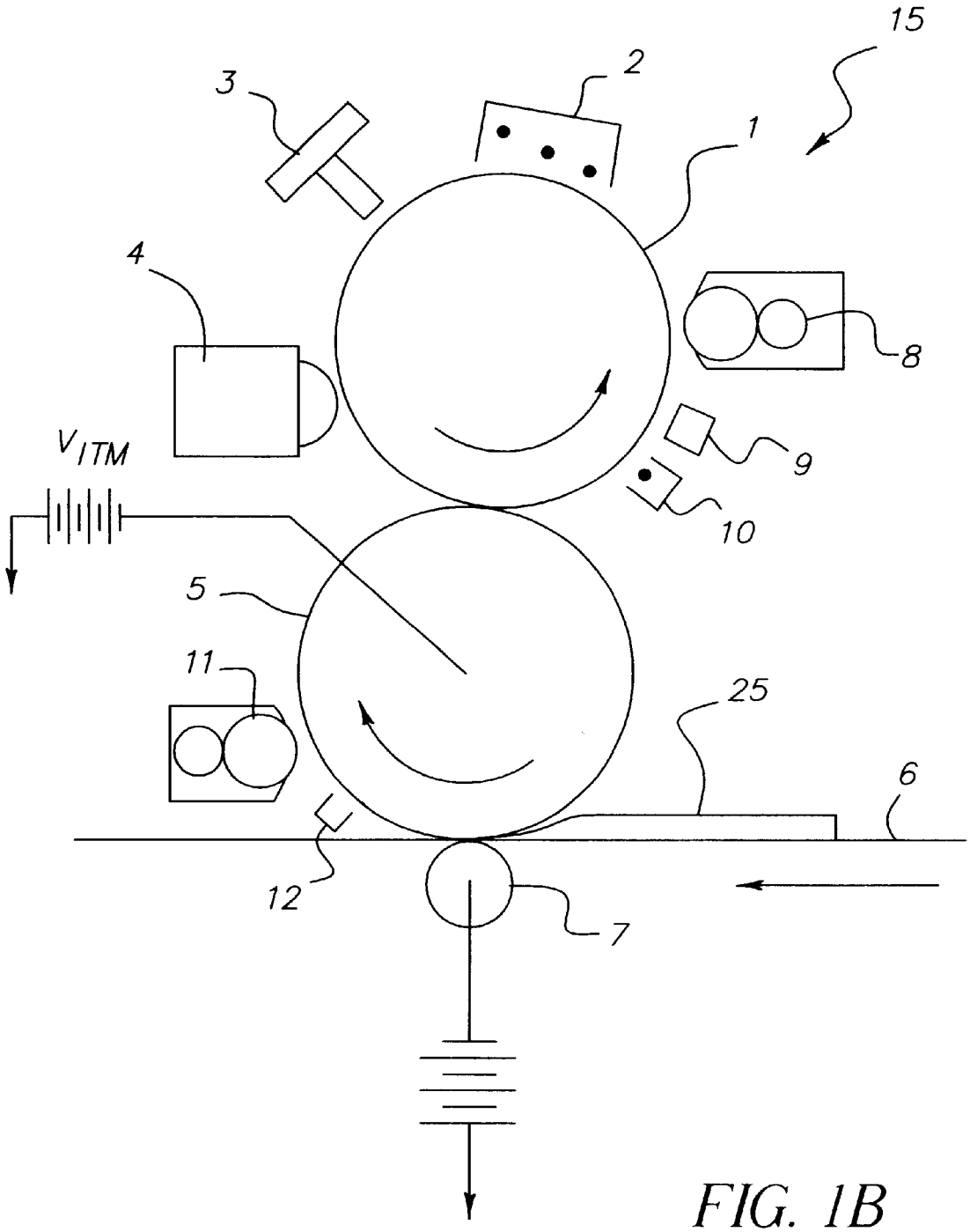

With reference also now to FIG. 2, the cleaning station 11 in FIG. 1B, is shown in greater detail. For illustrative purposes, only cleaning apparatus 11 is shown in detail; however, cleaning apparatus 8 is substantially similar. The cleaning station 11 has a housing 32 which encloses the cleaning brush 34. he cleaning brush 34 has conductive brush fibers 36 which, through an opening in the housing 32 engage the intermediate transfer member 5. The optional pre-cleaning-charging station 12 may be provided upstream of the area where the cleaning brush 34 contacts the intermediate transfer member 5 or photoconductive primary image member 1 to charge the toner particles 60 of the remnant toner.

The brush 34 is supported on a core 35 which is driven in rotation by a motor M or other motive source to rotate in the direction of the arrow A as the intermediate transfer member 5 is moved in the direction shown by arrow B. It is important to match the sense (direction) of rotation of the drum being cleaned, the electrostatic cleaning brush and the detone roller. As the brush rotates, untransferred toner particles 60 and other particulate debris, such as carrier particles and paper dust, on the intermediate transfer member 5 are mechanically scrubbed from the intermediate transfer member 5 and picked up into the conductive brush fibers 36.

The items illustrated in the figures are generally not shown to scale to facilitate understanding of the structure and operation of the apparatus. In particular, the brush fibers are shown much larger to scale than other structures shown in FIG. 2.

In addition to mechanical scrubbing ,an electrical bias is applied to the cleaning brush from power supply 39. The electric bias V1 of the power supply 39 to the cleaning brush 34 is, as will be more fully explained below, inductively, and not conductively, coupled to the conductive brush fiber 36. The voltage V1 is greater than the voltage bias $V_{ITM}$ applied and greater than the surface voltage of the intermediate transfer member 5 $_{VPC}$ Surface. The polarity of the voltage on the conductive brush fibers 36 is such as to electrostatically attract toner particles 60 to the conductive brush fibers 36.

The toner particles 60 entrained within the conductive brush fibers 36 are carried to a rotating detoning roller 40 which is electrically biased by power supply 39 to a higher voltage level V2 than the voltage level V1; i.e., the voltage level V2 is of a level to electrostatically attract the toner particles in the brush to the detoning roller. Assuming a positively charged toner image (although negatively charged toner could be used), as an example, the toner image may be attracted to the intermediate transfer member 5 that is biased to the voltage bias $V_{ITM}$ in the range of about −300 volts to about −1500 volts. The cleaning brush, in such an example would be biased to a potential V1 that is in the range of about −550 volts to about −1750 volts. The detoning roller in this example would be biased to a potential V2, which is in the range of about−800 volts to about −2000 volts. In considering relationships of voltage $V2>V1>V_{ITM}$ , the absolute values of the voltages are implied.

The toner particles 60 are electrostatically attracted to the roller surface 41 of detoning roller 40. The roller surface 41 of detoning roller 40 is rotated in the direction of arrow C by a drive from motor M counter to that of the brush fibers or alternatively in the same direction. The toner particles are carried by the roller surface 41 of the detoning roller 40 towards a stationary skive lade 42 which is supported as a cantilever at end 42*a* by a pivot pin 42*c* so that the s raping end 42*b* of the blade 42 engages the roller surface 41 of the detoning roller 40. Toner particles 60 scrubbed from the roller surface 41 are allowed to fall into a collection chamber 51 of housing 32 and periodically a drive such as from motor M or other motive source is provided to cause an auger 50 or other toner transport device to feed the toner to a waste receptacle. Alternatively, the collection receptacle may be provided attached to housing 32 so that particles fall into the receptacle directly and the auger may be eliminated.

The skive blade is made of a metal such as Phosphor Bronze and is of a thickness of less than 0.5 mm and is engaged by a spring force by deflecting the skive blade 42 with respect to the roller surface 41 of detoning roller 40. The skive blade 42 extends for the full working width of the roller surface 41 of detoning roller 40. Sleeve 41 is formed of polished aluminum or stainless steel and is electrically conductive; the skive blade 42 is an insulating material, such as urethane. The sleeve 41*a* is driven in rotation in the direction of arrow C and is electrically connected to potential V2.

A speed controller is schematically shown in FIG. 2. The speed controller will affect the operation of a motor turning the cleaning brush 34 by increasing or decreasing the operating speed of the motor to change the operating speed of the cleaning brush 34. The structure and operation of speed control devices are well known to those ordinarily skilled in the art and the details of such a device are not discussed herein. For example, a common speed control device is a variable resistor that controls the applied voltage to the motor. However, the invention is not limited to a variable resistor, but instead is applicable to all speed control devices.

As shown above, in a conductive fiber brush cleaning system, electrostatic forces are used to entrain the waste toner in a fiber matrix of the conductive fiber cleaning brush 34 after the waste toner particle. As also shown above, this system also employs a biased, magnetic core detone roller to electrostatically attract (scavenge) the waste toner from the conductive fiber cleaning brush 34 and collect it in a secondary container (e.g., see U.S. Pat. No. 5,905,932, in the name of Morse, et al.), incorporated herein by reference, that includes teachings of such a magnetic core 41.

Figure 3:
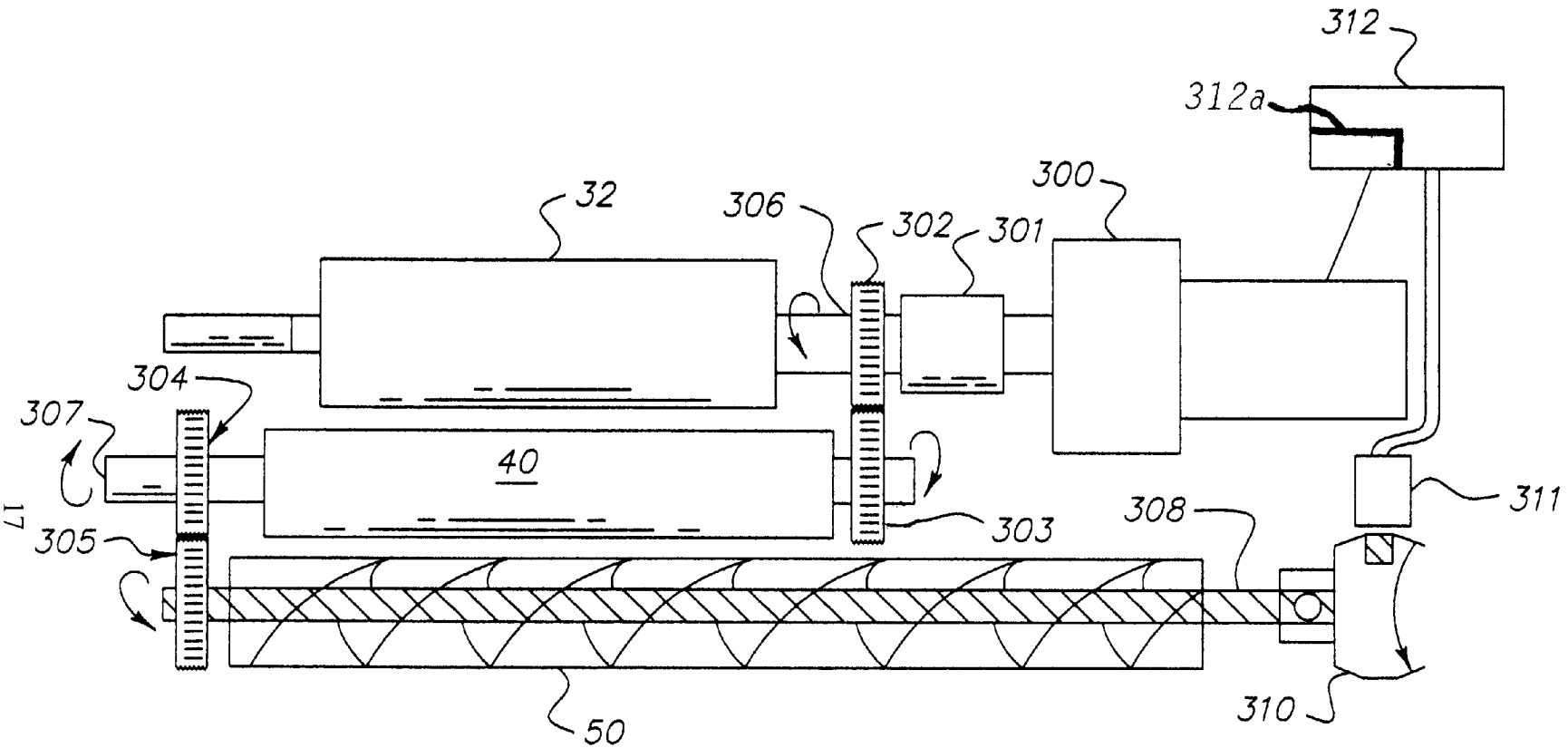
FIG. 3 is a side elevation schematic showing in greater detail the serial connections within the cleaning apparatus of FIG. 2.

Contrary to the parallel gear connections that are used conventionally, the invention uses a serial connection between the various devices within the cleaner apparatus. The connection is called a "serial" connection herein because (as shown in FIG. 3) the rotational force is transferred in series from the motor 300 through a drive coupling 301 to the tone brush gear 302 and then to the detoner roller gear 303 mounted on the detone roller axle 307. This same rotational force is then transferred from gear 304 to the waste auger gear 305. Because the force is transferred through a "series" of gears, this connection is called a "serial" connection. By using a serial connection, the invention allows a single sensor to detect a malfunction in any of the rotating devices. For example, if the waste auger 50 became jammed and was unable to turn, this would create a high current situation in the motor 300. Similarly, if the gear 304 malfunctioned (or became excessively worn), this would cause the waste auger 50 to stop rotating. This would reduce the load on the motor 300 and cause the current drawn by the motor to be lower.

Thus, in one embodiment, any unusual current situation experienced by the motor 300 (an excessively high or excessively low current) would be sensed by any well known current sensor (designated schematically at 312*a*) of a central processing unit 312 within the image processing apparatus. The amount of current change necessary to indicate a defect would vary depending upon the specific design of the cleaner. Therefore, the designer/manufacturer of the cleaner should establish a predetermined limit of allowable current variation. If the current change sensed by sensor 312*a* was determined by central processing unit 312 to exceed this limit, this would indicate a defect. In such a situation, the central processing unit 312 would recognize that a malfunction has occurred within the cleaning apparatus and preferably shuts the entire image processing apparatus down to prevent excessive contamination of the image processing apparatus.

As an alternative, or in addition to the current sensing embodiment shown above, the invention optionally includes a rotation sensor 311 that is adjacent an indicator 310 attached to the roller axle 308 of the waste augur 50. Any malfunction in any of the gears 302–305 or the axles 306–308 would prevent the waste auger 50 from rotating. The cessation of rotation would be detected by the rotation sensor 311 (when the indicator 310 stopped regularly passing by or change significantly in passing rate or the rotation sensor 311 changed significantly in passing rate) and a signal would be sent to central processing unit that a malfunction had occurred in the cleaning apparatus.

As would be known by one ordinarily skilled in the art given this disclosure, the indicator 310 and the rotation sensor 311 do not necessarily need to be connected to the auger 50. To the contrary, it is only important that the rotation sensor be connected to monitor the last rotating device in the serial chain. Indeed, the indicator 310 can be omitted or incorporated into an axle (or other moving component), so long as the rotation sensor 311 can reliably detect movement of the item in question. Therefore, if the DC motor 300 were connected directly to the auger, and the detone cleaning brush 32 were the last device in the serial chain, the invention would include the sensor adjacent the detoner brush axle 306. Similarly, many other configurations of serial connections to the motor 300 could be envisioned with the invention, so long as the sensor is positioned adjacent the last element in the serial chain. As with the previous embodiments, the malfunction signal from the rotation sensor 311 will allow the image processing apparatus to be shut down by the central processing unit 312 before contamination can occur.

As mentioned above, the failure of any drive component within an electrostatic cleaner device, prevents the cleaner assembly from operating properly and results in contamination of the image processing apparatus in which the cleaner is installed. The invention corrects the situation by providing a single point of failure detection of all drive components within the cleaner assembly. More specifically, the invention serially links all drive components to allow the current draw of the driving motor to indicate when a malfunction in any of the drive links has occurred. In addition, the invention can include a sensor adjacent the last drive component in the serial chain, which also allows any break in the serial chain to be immediately identified. By immediately identifying a malfunction in the drive components of the cleaner assembly, the invention prevents a defective cleaner assembly from continuing to operate. In doing so, the invention prevents a defective cleaner assembly from contaminating the entire image processing apparatus. Thus, with the invention, the user is simply provided an indication that the cleaner assembly needs to be replaced. Without the invention, not only would the cleaner assembly have to be replaced, but the entire apparatus would have to be decontaminated which is a substantially costly and time-consuming operation.

While the invention has been described in terms of preferred embodiments, those skilled in the art will recognize that the invention can be practiced with modification within the spirit and scope of the appended claims.

Parts List

1 primary image member
2 primary charging station
3 printhead
4 development station
5 intermediate transfer member
6 dielectric conveyor
7 transfer backing roller
8 cleaning station/apparatus
9 led lamp
10 cleaning-assist charger
11 cleaning station
12 pre-cleaning charging station
15 imaging-station
25 receiving sheet
30 fuser
32 housing
34 cleaning brush
35 core
36 conductive brush fibers
39 power supply
40 detoning roller
41 roller surface
41*a* sleeve
42 skive blade
42*a* end
42*b* scraping end
42*c* pivot pin
50 auger
51 collection chamber
60 toner particles
61 remnant toner
65 speed controller
300 motor
301 drive coupling
302 brush gear
303 roller gear
304 detone roller gear
305 auger gear
306 auger roller gear
308 roller axle
310 indicator
311 rotation sensor
312 central processing unit
312*a* current sensor

What is claimed is:

1. A cleaner assembly for an image processing apparatus, said cleaner assembly comprising:

a drive motor;

a plurality of rotatable cleaning components, including a detone brush, a detone roller, and a waste auger, wherein said rotatable cleaning components form a serial connection to distribute a rotational force produced by said drive motor;

a current sensor for sensing a current being drawn by said drive motor; and a central processing unit, associated with said current sensor, adapted to shut down said image processing apparatus if a current change within said drive motor due to a malfunction within at least one of said rotatable cleaning components, sensed by said current sensor, exceeds a predetermined amount.

2. The cleaner assembly in claim 1, wherein said rotatable cleaning components include a plurality of axles, and said serial connection includes a plurality of serially connected gears positioned on said plurality of axles respectively.

3. The cleaner assembly of claim 1, further comprising a rotation sensor adapted to sense a rotation of a last rotating cleaning component in said serial connection of rotatable cleaning components.

4. The cleaner assembly in claim 3, further comprising an indicator attached to said last cleaning component of said plurality of rotatable cleaning components to rotate therewith, wherein said rotation sensor detects movement of said indicator.

5. A detone cleaner assembly for an image processing apparatus, said cleaner assembly comprising:

a drive motor;

a plurality of rotating cleaning components, including a cleaning brush, a detone roller, and a waste auger, wherein said rotating cleaning components form a serial connection to distribute a rotational force produced by said drive motor; and a sensor adapted to sense a rotation of a last rotating cleaning component in said serial connection.

6. The cleaner assembly in claim 5, wherein said rotating cleaning components include a plurality of axles, and said serial connection includes a plurality of serially connected gears positioned on said plurality of axles respectively.

7. The cleaner assembly in claim 5, further comprising a current sensor for sensing a current being drawn by said drive motor, and wherein a central processing unit in response to said current sensor sensing a current, shuts down said image processing apparatus to prevent contamination of said image processing apparatus.

8. A method of monitoring a cleaner assembly for an image processing apparatus, said method comprising:

rotating a serial configuration of cleaning elements within said cleaner assembly via a drive motor;

monitoring a current being drawn by said drive motor;

sensing the current of said drive motor, and determining when such current has exceeded a predetermined limit; and shutting down said image processing apparatus if a current change within said drive motor exceeds such predetermined limit.

* * * * *